US006057820A

United States Patent [19]

Irwin

[11] Patent Number: 6,057,820

[45] Date of Patent: May 2, 2000

[54] APPARATUS AND METHOD FOR CONTROLLING CONTRAST IN A DOT-MATRIX LIQUID CRYSTAL DISPLAY

[75] Inventor: Dean S. Irwin, Novato, Calif.

[73] Assignee: Spatialight, Inc., Novato, Calif.

[21] Appl. No.: 09/097,765

[22] Filed: Jun. 16, 1998

Related U.S. Application Data

[63] Continuation of application No. 08/734,230, Oct. 21, 1996, abandoned, which is a continuation of application No. 08/606,147, Feb. 23, 1996, Pat. No. 5,754,414.

[51] Int. Cl.[7] ..... G09G 3/36

[52] U.S. Cl. ..... 345/96; 345/94

[58] Field of Search ..... 345/87, 88, 92, 345/94, 96

[56] References Cited

U.S. PATENT DOCUMENTS

| | | |
|---|---|---|
| 4,734,692 | 3/1988 | Hosono et al. . |
| 4,827,255 | 5/1989 | Ishii . |
| 4,870,396 | 9/1989 | Sheilds . |
| 5,173,687 | 12/1992 | Tanaka et al. . |
| 5,430,460 | 7/1995 | Takabatake et al. . |
| 5,606,338 | 2/1997 | Takeda et al. . |
| 5,614,922 | 3/1997 | Kawaguchi et al. . |
| 5,617,113 | 4/1997 | Prince . |
| 5,619,224 | 4/1997 | Hoshino et al. . |

FOREIGN PATENT DOCUMENTS

| | | |
|---|---|---|
| 0597828 | 5/1994 | European Pat. Off. . |
| 0599622 | 6/1994 | European Pat. Off. . |
| 406149180 | 5/1994 | Japan . |

*Primary Examiner*—Amare Mengistu

*Attorney, Agent, or Firm*—Gray Cary Ware & Freidenrich LLP

[57] ABSTRACT

An apparatus and method for controlling the contrast in a dot-matrix liquid crystal display (LCD) is provided wherein the voltages applied to the electrodes is phase shifted. The phase shifted electrode voltages avoids the problem that rows of the dot-matrix LCD may have long periods when the voltage on the front electrode and the back electrode are different polarities so that the contrast of the dot-matrix LCD across the rows is improved.

32 Claims, 8 Drawing Sheets

APPARATUS AND METHOD FOR CONTROLLING CONTRAST IN A DOT-MATRIX LIQUID CRYSTAL DISPLAY

This application is a of Ser. No. 08/734,230 filed Oct. 21, 1996, now abandoned which is a of Ser. No. 08/606,147 filed Feb. 23, 1996, issued as U.S. Pat. No. 5,754,414.

FIELD OF THE INVENTION

This invention relates in general to techniques for driving liquid crystal displays and in particular, to techniques applying alternating voltages to both front and back electrodes of dot-matrix liquid crystal displays for driving the dot-matrix liquid crystal displays.

BACKGROUND OF THE INVENTION

A dot-matrix liquid crystal display is formed by confining a thin layer of liquid crystal material between a transparent front plate having a front electrode, and a back plate having a matrix of back electrodes corresponding to dots or pixels. Individual dots are optically responsive to voltages applied across the liquid crystal material sandwiched between the front electrode and corresponding back electrodes. Alternating voltages are used to drive dot-matrix liquid crystal displays in order to avoid well known direct voltage drive problems such as electrolytic plating of the electrodes and electrochemical breakdown of the liquid crystal material.

Dot-matrix liquid crystal displays may be of the active-matrix or passive-matrix liquid crystal display types. When used as low power, flat panel substitutes for cathode-ray tubes, their drive circuitry commonly drive the dot-matrix liquid crystal displays from conventional cathode-ray tube (CRT) video, horizontal synchronization (HSYNC), and vertical synchronization (VSYNC) signals. When applying alternating voltages to both the front and back electrodes in such applications, contrast uniformity among the dots of the dot-matrix liquid crystal display may suffer for one or more display or frame refresh cycles following each alternation of the front electrode voltage. The problem is particularly bothersome in liquid crystal display (LCD) projection systems employing dot-matrix liquid crystal displays characterized by high dot densities in small display areas.

OBJECTS AND SUMMARY OF THE INVENTION

Accordingly, it is an object of the present invention to provide a technique for driving a dot-matrix liquid crystal display with alternating voltages applied to both front and back electrodes, which provides good contrast and pixel uniformity.

Another object is to provide a technique for driving a dot-matrix liquid crystal display with alternating voltages applied to both front and back electrodes, which minimizes constraints on the physical size or spacing of the pixels.

Yet another object is to provide a cost effective technique and drive circuitry for driving dot-matrix liquid crystal displays with alternating voltages applied to both front and back electrodes.

These and additional objects are accomplished by the various aspects of the present invention, wherein briefly stated, one aspect is a method of displaying images on a dot-matrix liquid crystal display having optical characteristics of individual dots responsive to alternating voltages on corresponding back electrodes and a front electrode, comprising the steps of: receiving data for frames of images to be displayed on the dot-matrix liquid crystal display; generating voltage signals for the back electrodes from the received data such that during alternating fixed number of refreshes of the frames, the back electrode voltage signals are respectively generated for first and second polarity modes; and generating a voltage signal for the front electrode such that during alternating fixed number of refreshes of the frames, the front electrode voltage signal is generated for the first and second polarity modes, and out of phase by approximately one half a refresh cycle from the back electrode voltages so that substantially none of the individual dots of the dot-matrix liquid crystal display is exposed to a voltage difference resulting from the corresponding back electrode and the front electrode being in different polarity modes for significantly more than one half the refresh cycle.

Another aspect is an apparatus for displaying images on a dot-matrix liquid crystal display. Included in the apparatus are means for receiving data for frames of images to be displayed on the dot-matrix liquid crystal display; means for generating voltage signals for the back electrodes from the received data such that during alternating fixed number of refreshes of the frames, the back electrode voltage signals are respectively generated for first and second polarity modes; and means for generating a voltage signal for the front electrode such that during alternating fixed number of refreshes of the frames, the front electrode voltage signal is generated for the first and second polarity modes, and out of phase by approximately one halt a refresh cycle from the back electrode voltages so that substantially none of the individual-dots of the dot-matrix liquid crystal display is exposed to a voltage difference resulting from the corresponding back electrode and the front electrode being in different polarity modes for significantly more than one half the refresh cycle.

Additional objects, features and advantages of the various aspects of the present invention will become apparent from the following description of its preferred embodiment, which description should be taken in conjunction with the accompanying drawings.

DETAILED DESCRIPTION OF THE PREFERRED EMBODIMENTS

Figure 1:
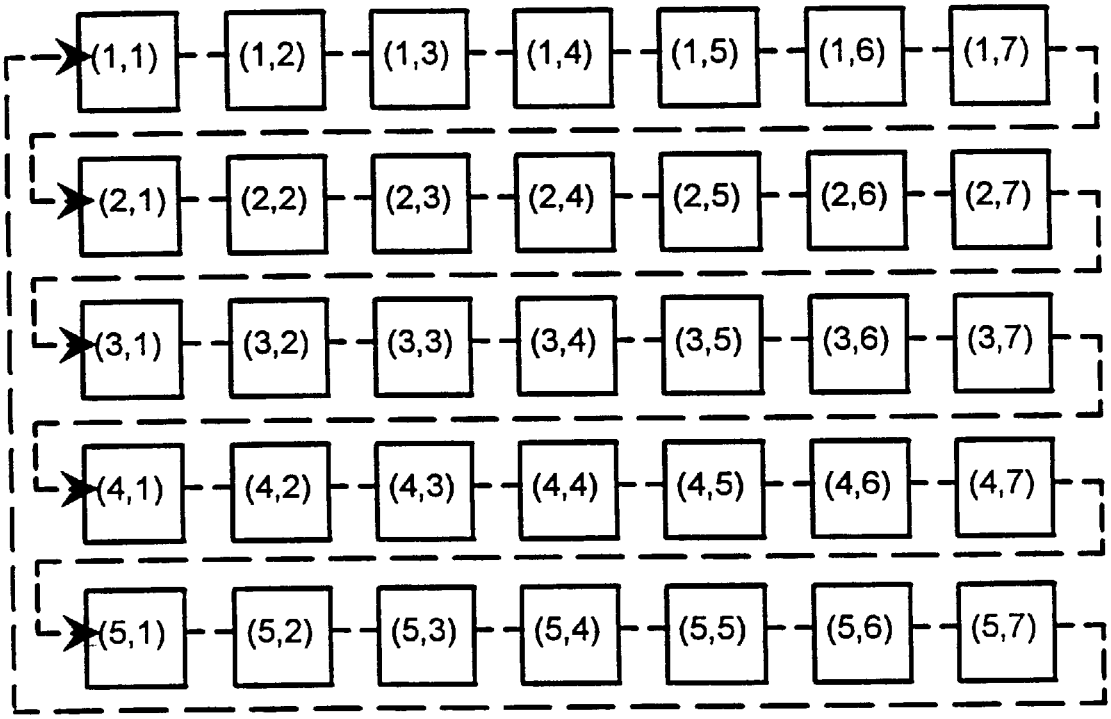
fig.1 prior art
FIG. 1 illustrates, as an example, a conventional raster-like scheme for refreshing a matrix of dots in a dot-matrix liquid crystal display.

FIG. 1 illustrates, as an example, a conventional raster-like scheme for refreshing a matrix of dots in a dot-matrix liquid crystal display. In the example, the matrix comprises five rows and seven columns of dots, wherein each dot or pixel is identified by its respective row and column in parentheses. As indicated by the dotted lines and arrows, the matrix is driven and refreshed in conventional fashion one-row at a time from top to bottom, then back to the top again to start a new refresh cycle. The time between updates to the data being concurrently displayed on the matrix is referred to as a frame cycle, and the display is generally refreshed a number of times during each frame cycle.

Figure 2:
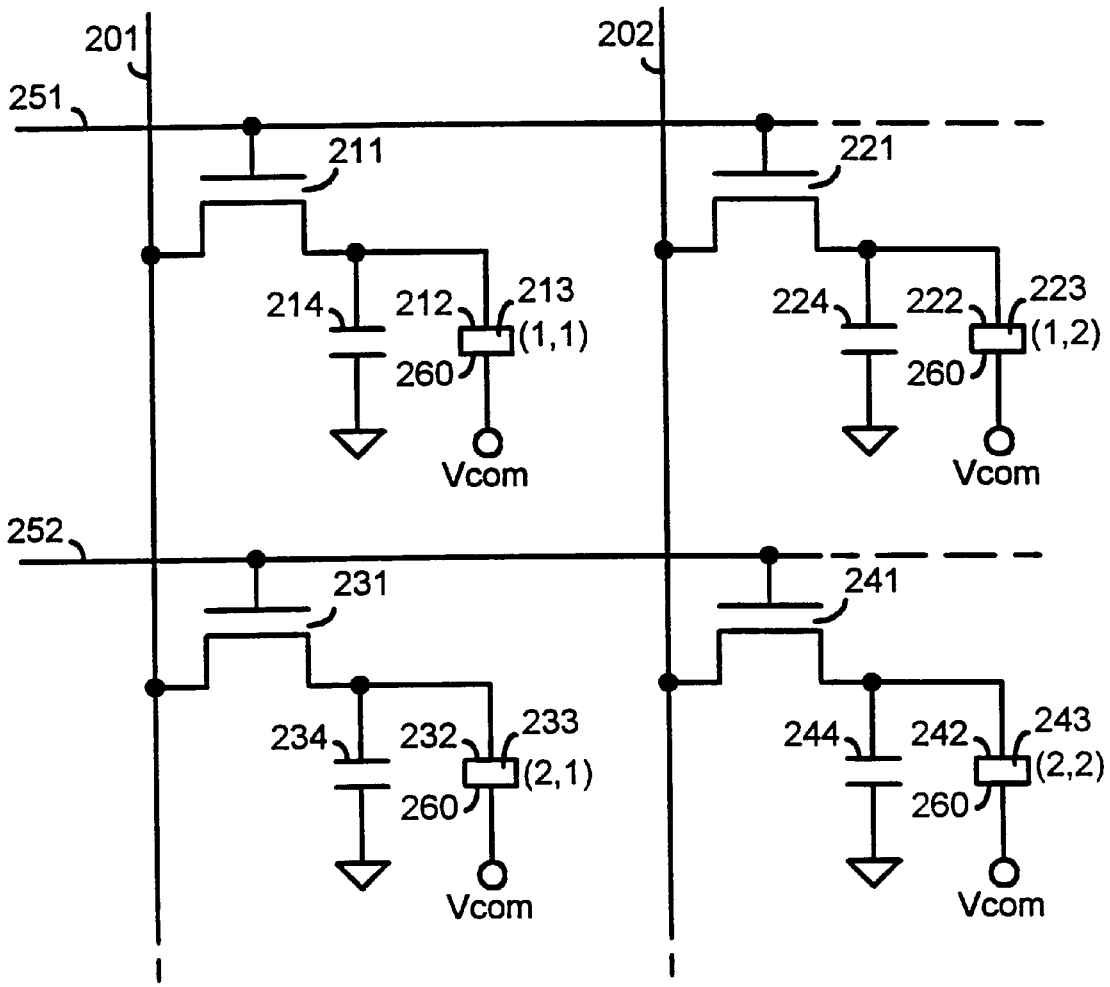
fig.2 prior art
FIG. 2 illustrates, as an example, a conventional circuit schematic for representative dots or pixels in a dot-matrix liquid crystal display.

FIG. 2 illustrates, as an example, a conventional circuit schematic for representative dots or pixels in a dot-matrix liquid crystal display. Pixel (1,1) comprises a back electrode 212, a common front electrode 260, and liquid crystal material 213 sandwiched between the back and common front electrodes, 212 and 260. A pixel driving circuit comprising a transistor 211 and a storage capacitor 214, serve as an elemental sample and hold circuit for the pixel (1,1). The transistor 211 has a control gate coupled to a row bus 251, a drain electrode coupled to a column bus 201, and a source electrode coupled to the storage capacitor 214 and the back electrode 212 of the pixel (1,1). The other end of the storage capacitor 214 is coupled to a ground reference.

Other pixels of the dot-matrix liquid crystal display are similarly constructed, as are their pixel driving circuits. Each row of pixels is formed such that the control gates of their pixel driving circuit transistors are coupled to a common row bus, and each column of pixels is formed such that the drain electrodes of their pixel driving circuit transistors are coupled to a common column bus.

To display a frame of images or text on the dot-matrix liquid crystal display, appropriate signal voltages are provided to the column buses which are properly timed with a voltage Vcom being provided to the common front electrode 260, and row scanning signals being sequentially provided to the row buses.

FIGS. 3*a*–3*e* illustrate, as examples, timing diagrams of selected voltages for one or more pixel driving circuits operating in binary monochrome mode. In the examples, the liquid crystal display is a reflective-type having twisted nematic liquid crystal material and a front polarizer oriented so that a pixel appears opaque to incident polarized light when its molecules are in an untwisted state, and appears clear or transparent to incident polarized light when its molecules are in a fully twisted state. Also in the following examples, the liquid crystal material has a threshold voltage of 2.0 volts so that the liquid crystal molecules of a pixel are normally in an untwisted state when a pixel display voltage Vpixel having an absolute value less than or equal to the threshold value of the liquid crystal material is applied across front and back electrodes of the pixel (e.g., $|Vpixel| \leqq Vth$, or $|Vpixel| \leqq 2$ volts), and conversely, are normally in a partially or fully twisted state when a pixel display voltage Vpixel having an absolute value greater than the threshold voltage is applied across the front and back electrodes of the pixel (e.g., $|Vpixel| > Vth$, or $|Vpixel| > 2$ volts). As the magnitude of the pixel display voltage Vpixel increases, the twist of the liquid crystal molecules increases and consequently, the transparency of the pixel to incident polarized light increases, until the liquid crystal molecules are fully twisted and the pixel is fully transparent to incident polarized light.

Figure 3A:
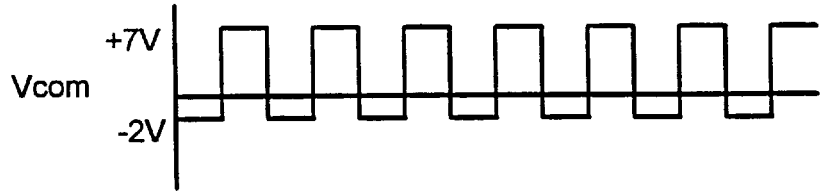
fig.3a prior art
FIGS. 3*a*–3*e* illustrate, as examples, timing diagrams of selected voltages for one or more pixel driving circuits operating in binary monochrome mode.
Figure 3B:
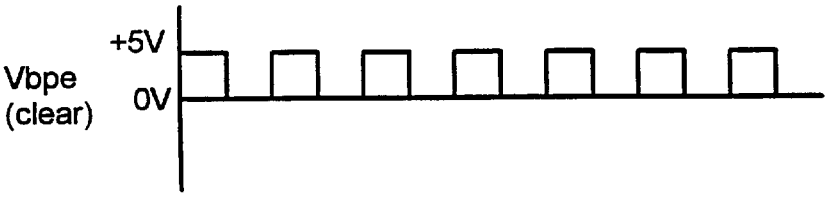
fig.3b prior art
Figure 3C:
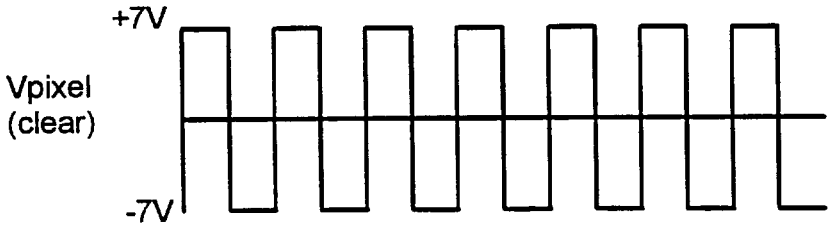
fig.3c prior art

FIG. 3*a* illustrates a voltage signal Vcom being applied to the common front electrode 260 of the dot-matrix liquid crystal display. The common front plate voltage signal Vcom is depicted as an AC signal having a DC offset. FIG. 3*b* illustrates a voltage signal Vbe being applied to a back electrode of the dot-matrix liquid crystal display. The back plate voltage signal Vbe is depicted as an AC signal 180 degrees out of phase with the front plate voltage signal Vcom and alternating between high and low logic level voltages of 5.0 and 0.0 volts. FIG. 3*c* illustrates a pixel display voltage Vpixel resulting from a difference of the back plate voltage signal Vbe of FIG. 3*b* and the front plate voltage signal Vcom of FIG. 3*a*. The resulting pixel display voltage Vpixel has an absolute value of 7.0 volts, which drives its corresponding pixel into a clear or transparent state since 7.0 volts is much greater than the LCD material threshold voltage of 2.0 volts.

Figure 3D:
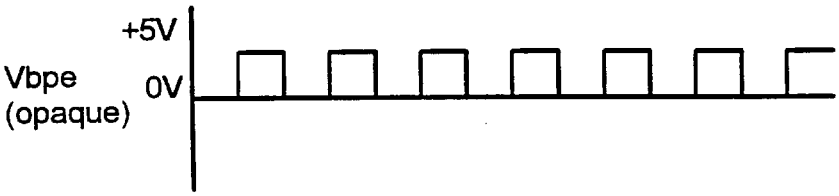
fig.3d prior art
Figure 3E:
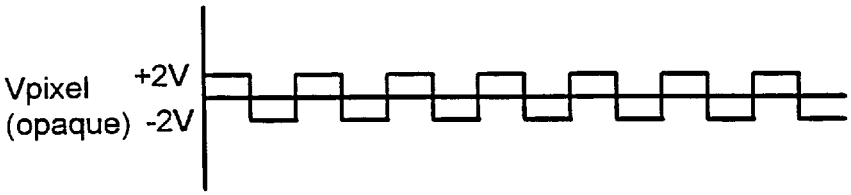
fig.3e prior art

FIG. 3*d*, on the other hand, illustrates another voltage signal Vbe being applied to a back electrode of the dot-matrix liquid crystal display. The back plate voltage signal Vbe is depicted as an AC signal in phase with the front plate voltage signal Vcom and alternating between low and high logic level voltages of 0.0 and 5.0 volts. FIG. 3*e* illustrates a pixel display voltage Vpixel resulting from the difference of the back plate voltage signal Vbe of FIG. 3*d* and the front plate voltage signal Vcom of FIG. 3*a*. The resulting pixel display voltage Vpixel has an absolute value of 2.0 volts, which drives its corresponding pixel into an opaque state since 2.0 volts is equal to the LCD material threshold voltage of 2.0 volts. By driving the opaque pixel with a pixel display voltage at or just below its threshold voltage level, the response time for turning the opaque pixel into a clear pixel is reduced.

Frames of images are thereupon displayed in a normal mode of operation on a dot-matrix liquid crystal display by applying AC signals such as depicted in FIG. 3*b*, which are 180 out of phase with the front plate voltage signal Vcom, to back electrodes which are to be clear, and AC signals such as depicted in FIG. 3*d*, which are in phase with the front plate voltage signal Vcom, to back electrodes which are to be opaque. In a reverse mode of operation, clear dots in normal mode operation are displayed as opaque dots, and opaque dots in normal mode operation are displayed as clear dots by reversing the phase relationships of their back plate and front plate voltage signals.

For convenience, the front plate voltage signal Vcom is referred to as being in a first polarity mode when it is at a maximum value of 7.0 volts, and in a second polarity mode when it is at a minimum value of −2.0 volts. Back plate voltage signals Vbe for normal mode clear dots and reverse mode opaque dots are referred to as being in the first polarity mode when they are at a minimum value of 0 volts, and in the second polarity mode when they are at a maximum value of 5.0 volts. Back plate voltage signals Vbe for normal mode opaque dots and reverse mode clear dots are referred to as being in the first polarity mode when they are at a maximum value of 5.0 volts, and in the second polarity mode when they are at a minimum value of 0 volts. As a consequence, when the front plate voltage signal Vcom is in the same polarity mode as the back plate voltage signals Vbe, images are being displayed on the dot-matrix liquid crystal display in normal mode operation, and when the front plate voltage signal Vcom is in a different polarity mode than the back plate voltage signals Vbe, images are being displayed on the dot-matrix liquid crystal display in reverse mode operation.

In the preferred embodiment of the present invention, the dot-matrix liquid crystal display is a reflective-mode active-matrix liquid crystal display having an array of 512×704 dots or pixels, which measures on the order of one-inch square for typically LCD projection system applications. The display receives standard CRT signals including a video signal (VIDEO) of rasterized data including frames of images to be displayed on the display, and conventional horizontal (HSYNC) and vertical (VSYNC) synchronization signals corresponding to the video signal. Each frame of images is displayed on the dot-matrix liquid crystal display for one cycle of the front plate voltage signal Vcom. In addition, each frame of images is refreshed sixteen times, eight times during the period of the frame when Vcom is at its minimum of −2.0 volts, and eight times during the period of the frame when Vcom is at its maximum of 7.0 volts.

As previously mentioned, one problem with conventional dot-matrix liquid crystal displays driven by alternating voltages to both front and back electrodes, is that uniformity in contrast between dots in the dot-matrix liquid crystal display may suffer following a voltage transition on the front electrode. To elaborate upon this problem, a simplified example is described in reference to FIG. 4, wherein a matrix such as depicted in FIG. 1 is refreshed only twice per frame cycle, once during the period of time when Vcom is at its maximum or first polarity mode, and once during the period of time when Vcom is at its minimum or second polarity mode.

Figure 4:
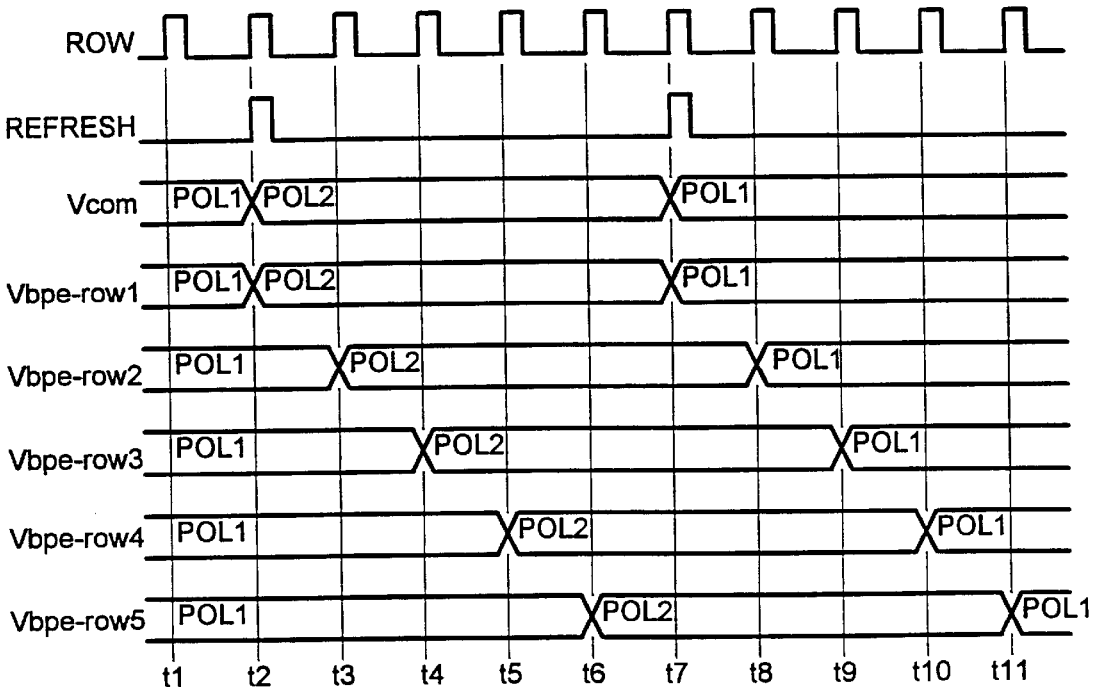
fig.4 prior art
FIG. 4 illustrates, as examples, timing diagrams for drive signals conventionally refreshing a dot-matrix liquid crystal display with alternating voltages applied to both front and back electrodes.

In particular, FIG. 4 illustrates timing diagrams for drive signals from one conventional technique for refreshing the simplified 5×7 dot-matrix liquid crystal display of FIG. 1, with alternating voltages applied to both front and back electrodes. In the figure, each pulse of the row signal (ROW) indicates that the refreshing of a next row of the dot-matrix liquid crystal display is being initiated, and each pulse of the refresh signal (REFRESH) indicates that a next refresh cycle of the dot-matrix liquid crystal display is being initiated. Prior to time t2, a refresh cycle with the front electrode voltage Vcom and the back electrode voltages Vbe for each row of the dot-matrix liquid crystal display in the first polarity mode (POL1), is being completed. At time t2, a new refresh cycle is initiated with the front electrode voltage Vcom being alternated to the second polarity mode (POL2), and the back electrode voltages Vbe-row1 for the first row of the dot-matrix liquid crystal display also being alternated to the second polarity mode (POL2). At times t3, t4, t5, and t6, the back electrode voltages Vbe-row2, Vbe-row3, Vbe-row4, and Vbe-row5 for respectively the second, third, fourth, and fifth rows of the dot-matrix liquid crystal display are thereupon sequentially alternated to the second polarity mode (POL2), so that the front electrode voltage Vcom and the respective back electrode voltages Vbe-row2, Vbe-row3, Vbe-row4, and Vbe-row5 are in different polarity modes for successively longer periods of time. At the extreme end, the front electrode voltage Vcom and the back electrode voltages Vbe-row5 for the fifth row of the dot-matrix liquid crystal display are in different polarity modes for almost the entire refresh cycle (i.e., until time t6). Consequently, contrast uniformity among the dots in the dot-matrix liquid crystal display severely suffers during this first refresh cycle.

U.S. Pat. No. 4,870,396, which is incorporated herein by this reference, solves the contrast uniformity problem by adding a control transistor for each pixel, which is interposed between the storage capacitor and the back electrode, and does not turn on until all of the storage capacitor voltages to be provided to the plate electrode voltages Vbe are in the same polarity mode as the common front electrode voltage Vcom. One disadvantage of such a technique, however, is that an additional control transistor is required for each pixel, thus adding to manufacturing costs.

Figure 5:
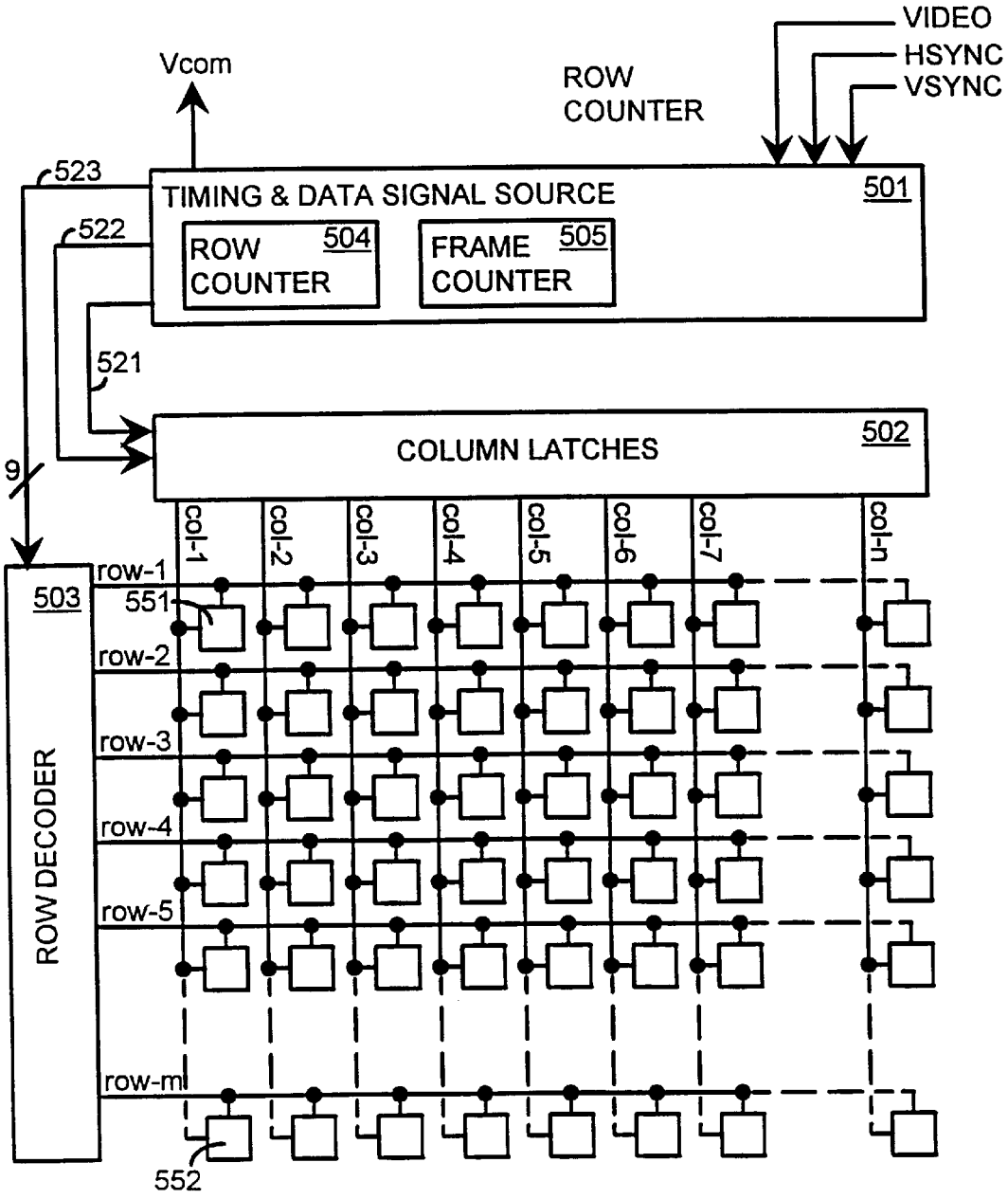
FIG. 5 illustrates, as an example, a block diagram of a drive circuit utilizing aspects of the present invention for driving and refreshing a dot-matrix liquid crystal display with alternating voltages applied to both front and back electrodes.

FIG. 5 illustrates, as an example, a block diagram of a drive circuit utilizing aspects of the present invention for driving and refreshing a dot-matrix liquid crystal display with alternating voltages applied to both front and back electrodes. A timing and data signal source circuit 501 receives conventional CRT video, HSYNC and VSYNC signals, extracts video data for displaying frames of text or images on the dot-matrix liquid crystal display from the received video signal, provides the extracted video data serially through a video line 521 to column latches 502, and generates a clock signal 522 provided to the column latches 502 for latching the video data for one row at a time into the column latches 502. The timing and data signal source circuit 501 also generates the front electrode voltage Vcom provided to the front electrode of the dot-matrix liquid crystal display, and row addresses provided to a row decoder circuit 503 through row address lines 523 for storing the latched video data in corresponding pixel storage capacitors for one row at a time, or refreshing video data already stored in the pixel storage capacitors for one row at a time.

Included in the timing and data signal source circuit 501 are a roll-over row counter 504 preferably receiving the HSYNC signal as input, and a roll-over frame counter 505 preferably receiving the VSYNC signal as input, so that the row counter 504 counts up to 512 rows as indicated by the HSYNC signal, then "rolls over" back to row one, and the frame counter 505 counts up to eight frames as indicated by the VSYNC signal, then "rolls over" back to frame one. The timing and data signal source circuit 501 generates the row address provided through row address lines 523 to the row decoder circuit 503 from an output of the row counter 504, and toggles the polarity modes of the video data provided to the column latches 501 and the front electrode voltage Vcom provided to the front electrode of the dot-matrix liquid crystal display in response to the frame counter 505 rolling over. In particular, each time the frame counter 505 rolls over, the polarity mode of the front electrode voltage Vcom is toggled after approximately one-half a refresh cycle delay (e.g., after the row counter 504 counts up to 256), so that the front electrode voltage Vcom is alternatingly in the 7.0 volts first polarity mode and the −2.0 volts second polarity mode for eight frames each. The timing and data signal source circuit 501 also toggles the polarity mode of the video data provided to the column latches 502 each time the frame counter 505 rolls over, so that the video data is alternatingly in the first polarity mode and the second polarity mode for eight frames each.

Figure 6:
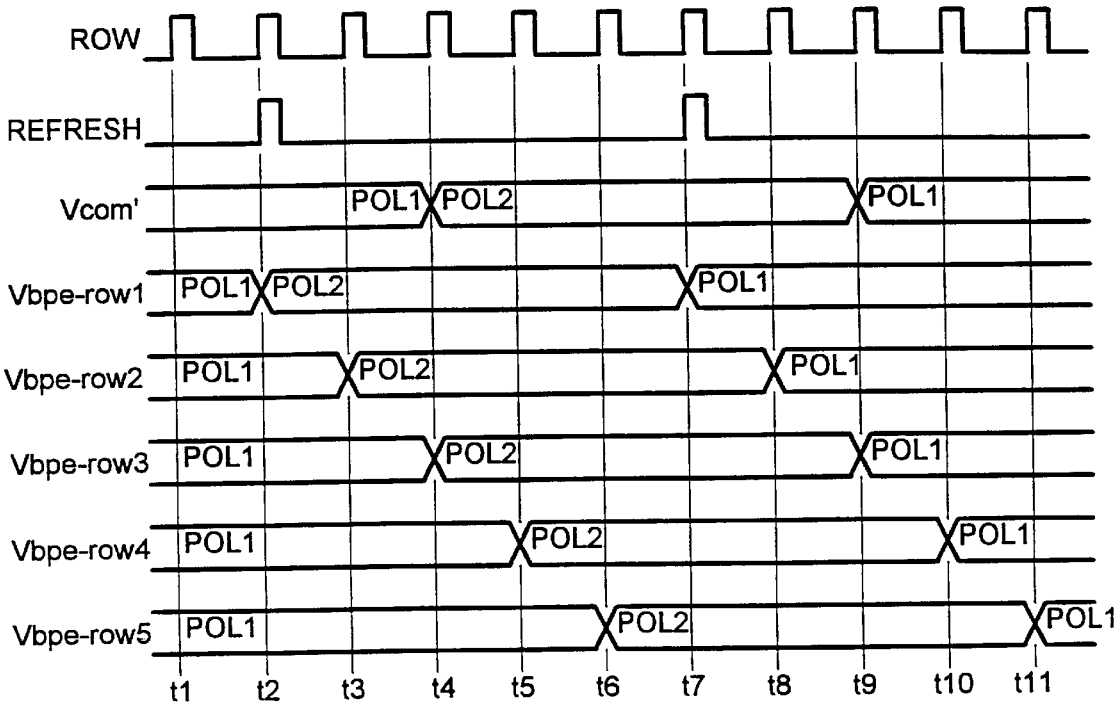
FIG. 6 illustrates, as examples, timing diagrams for drive signals utilizing aspects of the present invention to drive and refresh a dot-matrix liquid crystal display with alternating voltages applied to both front and back electrodes.

FIG. 6 illustrates, as examples, timing diagrams for drive signals utilizing aspects of the present invention to drive and refresh a dot-matrix liquid crystal display with alternating voltages applied to both front and back electrodes. To simplify description of the inventive technique, a simplified example is described, such as described in reference to FIG. 4, wherein a dot-matrix such as depicted in FIG. 1 is refreshed only twice per frame cycle, once during the period of time when Vcom is at its maximum or first polarity mode, and once during the period of time when Vcom is at its minimum or second polarity mode.

In FIG. 6, each pulse of the row signal (ROW) indicates that the refreshing of a next row of the dot-matrix liquid crystal display is being initiated, and each pulse of the refresh signal (REFRESH) indicates that a next refresh cycle is being initiated. Prior to time t2, a refresh cycle with the front electrode voltage Vcom and the back electrode voltages Vbe for each row of the dot-matrix liquid crystal display in the first polarity mode (POL1), is being completed. At time t2, a new refresh cycle is initiated with the back electrode voltages Vbe-row1 for the first row of the dot-matrix liquid crystal display being alternated to the second polarity mode (POL2), and at times t3, t4, t5, and t6, the back electrode voltages Vbe-row2, Vbe-row3, Vbe-row4, and Vbe-row5 for respectively the second, third, fourth, and fifth rows of the dot-matrix liquid crystal display are also successively alternated to the second polarity mode (POL2). At time t4, at approximately one-half of the refresh cycle, the front electrode voltage Vcom is alternated to the second polarity mode (POL2). As a consequence of delaying the alternation of the front electrode voltage Vcom by approximately one-half the refresh cycle, the front electrode voltage Vcom and the back electrode voltages Vbe-row1 for the first row are in different polarity modes for no more than one-half the refresh cycle (i.e., from time t2 to t4), and the front electrode voltage Vcom and the back electrode voltages Vbe-row5 for the fifth row are in different polarity modes for no more than one-half the refresh cycle (i.e., from time t4 to t6). Consequently, contrast uniformity among the dots in the dot-matrix liquid crystal display is improved as compared to the prior art technique described in reference to FIG. 4 since no row of the dot-matrix liquid crystal display has back electrode voltages Vbe which are in a different polarity mode than the front electrode voltage Vcom for more than one-half the refresh cycle, whereas in the prior art technique described in reference to FIG. 4, the back electrode voltages Vbe-row5 for the fifth row of the dot-matrix liquid crystal display are in a different polarity mode than the front electrode voltage Vcom for almost the entire refresh cycle.

Figure 7:
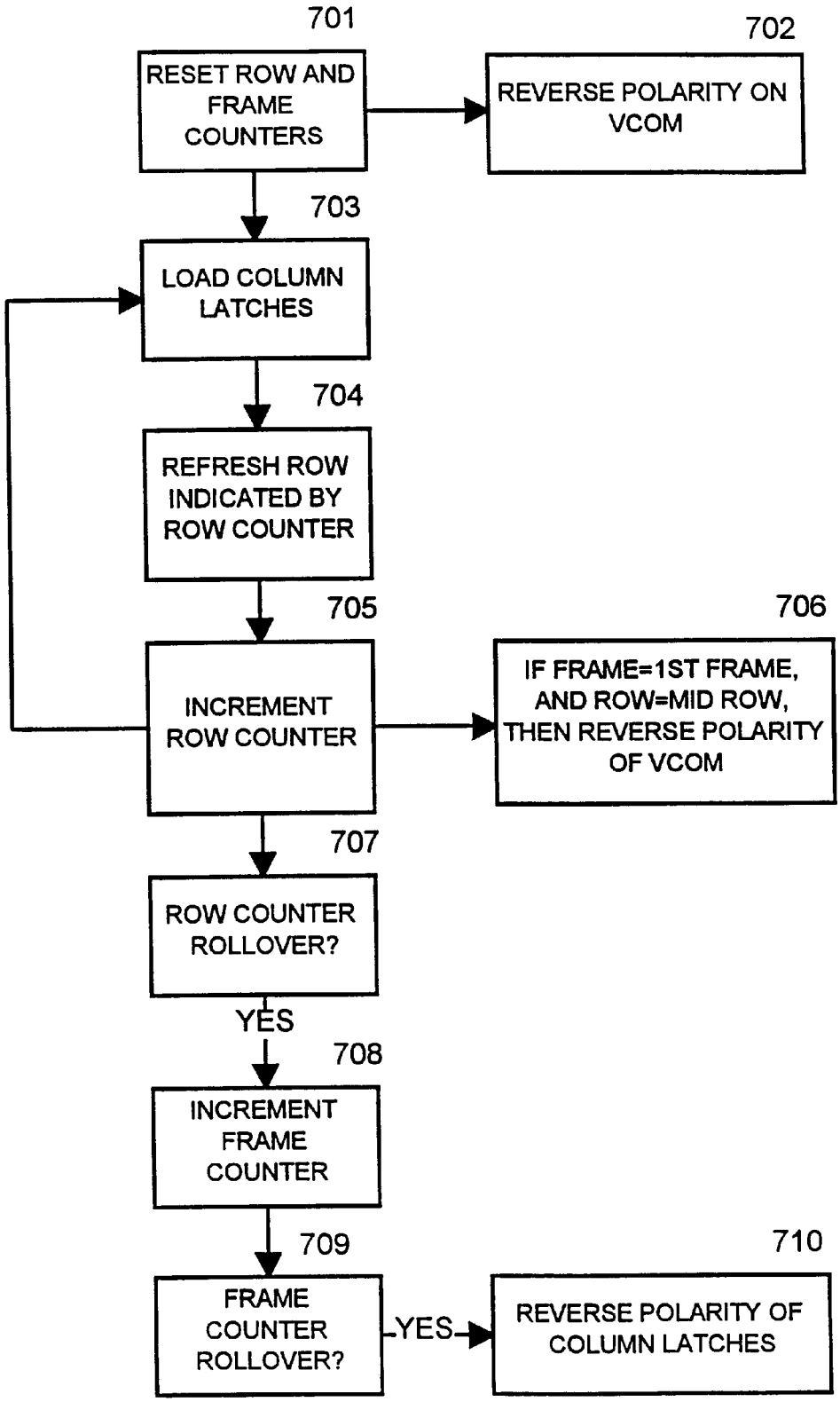
FIG. 7 illustrates, as an example, a flow diagram of a method utilizing aspects of the present invention, for driving and refreshing a dot-matrix liquid crystal display with alternating voltages applied to both front and back electrodes.

FIG. 7 illustrates, as an example, a flow diagram of a method utilizing aspects of the present invention, for driving and refreshing a dot-matrix liquid crystal display with alternating voltages applied to both front and back electrodes. In a first step 701, the timing and data signal source circuit 501 resets the row counter 504 and the frame counter 505, and reverses the polarity mode on the front electrode voltage Vcom so that it is initially in a different polarity mode than the back electrode voltages Vbe. In a next step 703, the timing and data signal source circuit 501 loads a row of video data into the column latches 502. In step 704, the row indicated by the row counter 504 is refreshed by the timing and data signal source circuit 501 providing a row address corresponding to the row to the row decoder circuit 503, and the row decoder circuit 503 in response, activating a row drive signal for the corresponding one of the row buses, row-1 to row-m. The activated row drive signal thereupon turns on the pixel transistors, such as pixel transistors 211 and 212 in FIG. 2, only in that row, causing the pixel storage capacitors, such as pixel storage capacitors 214 and 224 in FIG. 2, in that row to be charged up to corresponding voltages stored in the column latches 502. In step 705, after refreshing the row indicated by the row counter 504, the row counter 504 is incremented, and steps 703 to 705 are repeated for a next row of the dot-matrix liquid crystal display to be refreshed. In step 706, the polarity of the front electrode voltage Vcom is reversed so that it is placed into the same polarity mode as the video data being loaded into the column latches 502, upon the row counter 504 indicating a count equal to approximately the middle row of the dot-matrix liquid crystal display while the frame counter 505 is indicating the first frame. In the preferred embodiment of the invention wherein the dot-matrix liquid crystal display is a 512×704 dot resolution display, so that the middle row is row 256, and the polarity of the front electrode voltage Vcom is reversed so that it is placed into the same polarity mode as the video data being loaded into the column latches 502, upon the row counter 504 indicating a count equal to 256 while the frame counter 505 is indicating the initial or rolled-over count of 1. In step 707, after incrementing the count of the row counter 504, the count is checked to see if it has rolled-over back to the initial count of 1. If the count has rolled-over, then in step 708, the count of the frame counter 505 is incremented. In step 709, after incrementing the count of the frame counter 505, the count is checked to see if it has rolled-over back to the initial count of 1. If the count has rolled-over, then in step 710, the polarity of the front electrode voltage Vcom is reversed so that it is placed mode of the video data being loaded into the column latches 502 is reversed so as to be in a different polarity mode as the front electrode voltage Vcom. In the preferred embodiment of the invention, this occurs every eight frames.

Figure 8:
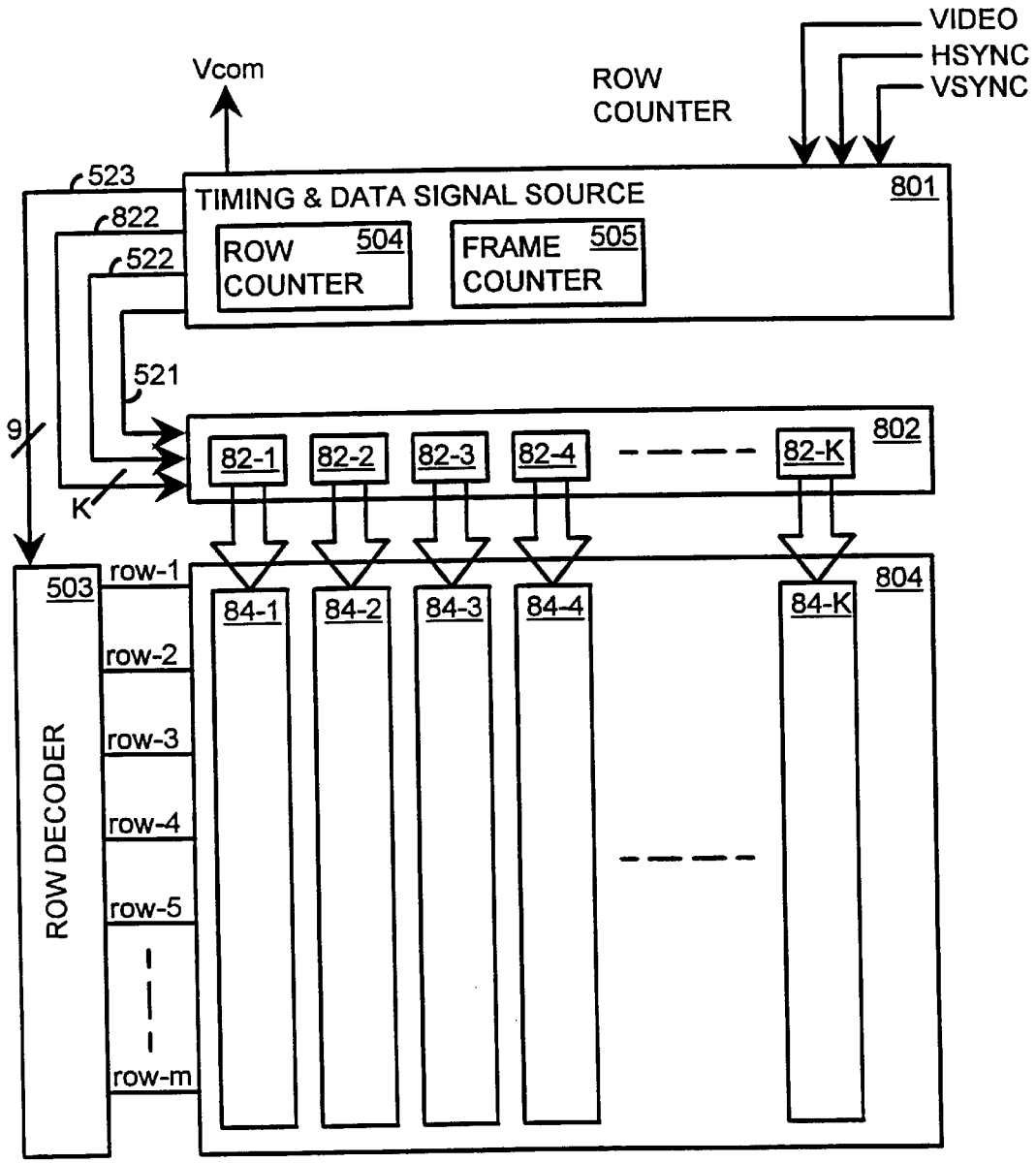
FIG. 8 illustrates, as an example, a block diagram of a drive circuit including column drive circuitry utilizing aspects of the present invention for driving and refreshing a dot-matrix liquid crystal display with alternating voltages applied to both front and back electrodes.

FIG. 8 illustrates, as an example, a block diagram of a preferred drive circuit including multiple column latch circuits, 82-1 to 82-k, utilizing aspects of the present invention for driving and refreshing a dot-matrix liquid crystal display with alternating voltages applied to both front and back electrodes. The drive circuit of FIG. 8 principally differs from the drive circuit of FIG. 5 in that the column latch circuit 802 of FIG. 8 includes multiple column latch circuits, 82-1 to 82-11, instead of the single column latch circuit 502 of FIG. 5, and the timing and data signal source circuit 801 of FIG. 8 generates latch enable signals provided to corresponding ones of the column latch circuits, 82-1 to 82-k, through enable signal lines 822, and provides row addresses at a faster rate than the timing and data signal source circuit 501 of FIG. 5. The column latch circuits, 82-1 to 82-k, are coupled to corresponding subarrays, 84-1 to 84-K, of the dot-matrix liquid crystal display. The timing and data signal source circuit 801 activates each of the latch enable signals in such a fashion that each of the column latch circuits, 82-1 to 82-K, latches its respective portion of the serialized video data provided by the timing and data signal source circuit 801 through the video line 521. For example, wherein each of the column latch circuits, 82-1 to 82-K, stores 64 bits, column latch circuit 82-1 is enabled while video data for columns 1–64 are being provided by the timing and data signal source circuit 801 through the video line 521, column latch circuit 82-2 is enabled while video data for columns 65–128 are being provided by the timing and data signal source circuit 801 through the video line 521, and so on, until column latch circuit 82-11 is enabled while video data for columns 641–704 are being provided by the timing and data signal source circuit 801 through the video line 521. The timing and data signal source circuit 801 provides the row addresses to the row decoder 503 at K times the rate of the timing and data signal source circuit 501 of FIG. 5, so that each time a portion of the video data for a row is latched into one of the multiple latch circuits, 82-1 to 82-K, the latched data is stored into the corresponding pixel storage capacitors without having to wait until the entire row of video data is latched in. Consequently, contrast uniformity between the dots of the dot-matrix liquid crystal is further enhanced.

Although the various aspects of the present invention have been described with respect to preferred embodiments, it will be understood that the invention is entitled to full protection within the full scope of the appended claims.

What is claimed is:

1. A method of controlling the contrast of a dot-matrix liquid crystal display that displays images having optical characteristics of individual dots responsive to voltages applied to corresponding back electrodes and a front electrode, the individual dots being grouped into a plurality of rows, the method comprising:

controlling the contrast of the dot-matrix liquid crystal display by controlling the voltages applied to the row of dots in the dot-matrix liquid crystal display so that the contrast of the dot-matrix liquid crystal device is improved;

the controlling further comprising applying a refresh signal to said dot-matrix liquid crystal display, switching the polarity of the voltages applied to the back electrodes of a first predetermined number of rows from a first polarity to a second polarity, switching the polarity of the voltage applied to said front electrode from the first polarity to the second polarity after the polarity of the voltages applied to the back electrodes of the first predetermined number of rows has been switched, and switching the polarity of the voltage applied to the back electrodes of the remaining rows of the dot-matrix liquid crystal display from the first polarity to the second polarity after the switching of the polarity of the voltage applied to the front electrode so that substantially none of the individual rows of the dot-matrix liquid crystal display is exposed to a voltage difference resulting from the corresponding back electrode and said front electrode being in different polarity modes for significantly more than one half the refresh cycle and the contrast of the dot-matrix liquid crystal display is improved.

2. The method as recited in claim 1, wherein said data receiving step comprises the step of receiving a video signal having raster data for frames of images to be displayed on said dot-matrix liquid crystal display, and horizontal and vertical synchronization signals corresponding to the raster data, such that individual frame cycles are characterized by individual pulses of the vertical synchronization signal, and by a predetermined number of pulses of the horizontal synchronization signal.

3. The method as recited in claim 2, wherein a normal mode of displaying images on the dot-matrix liquid crystal display is characterized by said back electrode voltage signals and said front electrode voltage signal being in the same polarity mode, and a reverse mode of displaying images on the dot-matrix liquid crystal display is characterized by said back electrode voltage signals and said front electrode voltage signal being in different polarity modes.

4. The method as recited in claim 3, wherein said back electrode voltage signals generating step comprises the steps of:

generating a count of vertical synchronization signal pulses, and resetting said vertical synchronization signal pulse count each time after counting up to said fixed number; and generating said back electrode voltage signals from said received video signal such that during alternating resettings of said vertical synchronization signal pulse count, said back electrode voltage signals are respectively generated for said first and second polarity modes.

5. The method as recited in claim 4, wherein said front electrode voltage signal generating step comprises the steps of:

generating a count of horizontal synchronization signal pulses, and resetting said horizontal synchronization signal pulse count each time after counting up to said predetermined number; and generating said front electrode voltage signal such that said front electrode voltage signals is delayed until said horizontal synchronization signal pulse count reaches a delay count of approximately one half said predetermined number following resetting of both said horizontal and vertical synchronization signal pulse counts.

6. The method as recited in claim 5, wherein said front electrode voltage signal generating step further comprises the step of generating said front electrode voltage signal such that following the horizontal synchronization signal delay count after alternating resettings of said vertical synchronization signal pulse count, said front electrode voltage signal is generated for said first and second polarity modes.

7. An apparatus for displaying images on a dot-matrix liquid crystal display having optical characteristics of individual dots responsive to voltage differences between corresponding back electrodes and a front electrode, comprising:

means for receiving data for frames of images to be displayed on said dot-matrix liquid crystal display;

means for generating voltage signals for the back electrodes from said received data such that during alternating fixed number of refreshes of said frames, said back electrode voltage signals are respectively generated a first and second polarity modes; and means for generating a voltage signal for the front electrode such that during alternating fixed number of refreshes of said frames, said front electrode voltage signal is generated for said first and second polarity modes, and out of phase by approximately one half a refresh cycle from said back electrode voltages so that substantially none of the individual dots of the dot-matrix liquid crystal display is exposed to a voltage difference resulting from the corresponding back electrode and said front electrode being in different polarity modes for significantly more than one half the refresh cycle.

8. The apparatus as recited in claim 7, wherein said received data includes a video signal having raster data for frames of images to be displayed on said dot-matrix liquid crystal display, and horizontal and vertical synchronization signals corresponding to the raster data, such that individual frame cycles are characterized by individual pulses of the vertical synchronization signal, and by a predetermined number of pulses of the horizontal synchronization signal.

9. The apparatus as recited in claim 8, wherein a normal mode of displaying images on the dot-matrix liquid crystal display is characterized by said back electrode voltage signals and said front electrode voltage signal being in the same polarity mode, and a reverse mode of displaying images on the dot-matrix liquid crystal display is characterized by said back electrode voltage signals and said front electrode voltage signal being in different polarity modes.

10. The apparatus as recited in claim 9, wherein said back electrode voltage signals generating means comprises:

means for generating a count of vertical synchronization signal pulses, and resetting said vertical synchronization signal pulse count each time after counting up to said fixed number; and means for generating said back electrode voltage signals from said received phase signal such that during alternating resettings of said vertical synchronization signal pulse count, said back electrode voltage signals are respectively generated for said first and second polarity modes.

11. The apparatus as recited in claim 10, wherein said front electrode voltage signal generating means comprises:

means for generating a count of horizontal synchronization signal pulses, and resetting said horizontal synchronization signal pulse count each time after counting up to said predetermined number; and means for generating said front electrode voltage signal such that said front electrode voltage signals is delayed until said horizontal synchronization signal pulse count reaches a delay count of approximately one half said predetermined number following resetting of both said horizontal and vertical synchronization signal pulse counts.

12. The apparatus as recited in claim 11, wherein said front electrode voltage signal generating means further comprises means for generating said front electrode voltage signal such that following the horizontal synchronization signal delay count after alternating resettings of said vertical synchronization signal pulse count, said front electrode voltage signal is generated for said first and second polarity modes.

13. The apparatus as recited in claim 7, wherein said dot-matrix liquid crystal display includes liquid crystal material having a response time greater than one half the refresh cycle.

14. The apparatus as recited in claim 7, wherein said dot-matrix liquid crystal display is an active-matrix liquid crystal display.

15. The apparatus as recited in claim 7, wherein said dot-matrix liquid crystal display is a passive-matrix liquid crystal display.

16. The apparatus as recited in claim 7, wherein said dot-matrix liquid crystal display includes a transparent front plate having a single front electrode.

17. An apparatus for controlling the contrast of a dot-matrix liquid crystal display to display images having optical characteristics of individual dots responsive to voltages applied to corresponding back electrodes and a front electrode, the liquid crystal display having a predetermined number of rows of individual, the voltages on the back electrodes and the front electrode having a first and second polarity, comprising:

means for applying a refresh signal to said dot-matrix liquid crystal display; and means for improving the contrast of the LCD comprising means for switching the polarity of the voltages applied to said back electrodes from the first polarity to the second polarity for the rows of the dot-matrix liquid crystal display, means for switching the polarity of the voltage applied to said front electrode from the first polarity to the second polarity after voltage applied to the first row has been switched but before the voltage applied to the last row has been switched so that substantially none of the individual dots of the dot-matrix liquid crystal display is exposed to a voltage difference resulting from the corresponding back electrode and said front electrode being in different polarity modes for significantly more than one half the refresh cycle.

18. The method as recited in claim 1, wherein said data receiving step comprises the step of receiving a video signal having raster data for frames of images to be displayed on said dot-matrix liquid crystal display, and horizontal and vertical synchronization signals corresponding to the raster data, such that individual frame cycles are characterized by individual pulses of the vertical synchronization signal, and by a predetermined number of pulses of the horizontal synchronization signal.

19. The method as recited in claim 18, wherein a normal mode of displaying images on the dot-matrix liquid crystal display is characterized by said back electrode voltage signals and said front electrode voltage signal being in the same polarity mode, and a reverse mode of displaying images on the dot-matrix liquid crystal display is characterized by said back electrode voltage signals and said front electrode voltage signal being in different polarity modes.

20. The method as recited in claim 19, wherein said back electrode voltage signals generating step comprises the steps of:

generating a count of vertical synchronization signal pulses, and resetting said vertical synchronization signal pulse count each time after counting up to a predetermined number; and generating said back electrode voltage signals from said received video signal such that during alternating resettings of said vertical synchronization signal pulse count, said back electrode voltage signals are respectively generated for said first and second polarity modes.

21. The method as recited in claim 20, wherein said front electrode voltage signal generating step comprises the steps of:

generating a count of horizontal synchronization signal pulses, and resetting said horizontal synchronization signal pulse count each time after counting up to a predetermined number; and generating said front electrode voltage signal such that said front electrode voltage signal is delayed until said horizontal synchronization signal pulse count reaches a delay count of approximately one half said predetermined number following resetting of both said horizontal and vertical synchronization signal pulse counts.

22. The method as recited in claim 21, wherein said front electrode voltage signal generating step further comprises the step of generating said front electrode voltage signal such that following the horizontal synchronization signal delay count after alternating resettings of said vertical synchronization signal pulse count, said front electrode voltage signal is generated for said first or second polarity modes.

23. An apparatus for controlling the contrast of a dot-matrix liquid crystal display that displays images having optical characteristics of individual dots responsive to voltages applied to corresponding back electrodes and a front electrode, the liquid crystal display having a predetermined number of rows of individual dots, and the voltages on the back electrodes and the front electrode having a first and second polarity, comprising:

means for controlling the contrast of the dot-matrix liquid crystal display by controlling the voltages applied to the row of dots in the dot-matrix liquid crystal display so that the contrast across the rows of the dot-matrix liquid crystal display is improved; and the controlling means further comprising means for applying a refresh signal to said dot-matrix liquid crystal display, means for switching the polarity of the voltages applied to the back electrodes of a first predetermined number of rows from the first polarity to the second polarity, means for switching the polarity of the voltage applied to said front electrode from the first polarity to the second polarity after the polarity of the voltages applied to the back electrodes of the first predetermined number of rows has been switched, and means switching the polarity of the voltage applied to the back electrodes of the remaining rows of the dot-matrix liquid crystal display from the first polarity to the second polarity after the switching of the polarity of the voltage applied to the front electrode so that substantially none of the individual rows of the dot-matrix liquid crystal display is exposed to a voltage difference resulting from the corresponding back electrode and said front electrode being in different polarity modes for significantly more than one half the refresh cycle and the contrast of the dot-matrix liquid crystal display is improved.

24. The apparatus as recited in claim 23, wherein said received data includes a video signal having raster data for frames of images to be displayed on said dot-matrix liquid crystal display, and horizontal and vertical synchronization signals corresponding to the raster data, such that individual frame cycles are characterized by individual pulses of the vertical synchronization signal, and by a predetermined number of pulses of the horizontal synchronization signal.

25. The apparatus as recited in claim 24, wherein a normal mode of displaying images on the dot-matrix liquid crystal display is characterized by said back electrode voltage signals and said front electrode voltage signal being in the same polarity mode, and a reverse mode of displaying images on the dot-matrix liquid crystal display is characterized by said back electrode voltage signals and said front electrode voltage signal being in different polarity modes.

26. The apparatus as recited in claim 25, wherein said back electrode voltage signals generating means comprises:

means for generating a count of vertical synchronization signal pulses, and resetting said vertical synchronization signal pulse count each time after counting up to said fixed number; and means for generating said back electrode voltage signals from said received phase signal such that during alternating resettings of said vertical synchronization signal pulse count, said back electrode voltage signals are respectively generated for said first and second polarity modes.

27. The apparatus as recited in claim 26, wherein said front electrode voltage signal generating means comprises:

means for generating a count of horizontal synchronization signal pulses, and resetting said horizontal synchronization signal pulse count each time after counting up to said predetermined number; and means for generating said front electrode voltage signal such that said front electrode voltage signal is delayed until said horizontal synchronization signal pulse count reaches a delay count of approximately one half said predetermined number following resetting of both said horizontal or vertical synchronization signal pulse counts.

28. The apparatus as recited in claim 27, wherein said front electrode voltage signal generating means further comprises means for generating said front electrode voltage signal such that following the horizontal synchronization signal delay count after alternating resettings of said vertical synchronization signal pulse count, said front electrode voltage signal is generated for said first or second polarity modes.

29. The apparatus as recited in claim 23, wherein said dot-matrix liquid crystal display includes liquid crystal material having a response time greater than one half the refresh cycle.

30. The apparatus as recited in claim 23, wherein said dot-matrix liquid crystal display is an active matrix liquid crystal display.

31. The apparatus as recited in claim 23, wherein said dot-matrix liquid crystal display is a passive-matrix liquid crystal display.

32. The apparatus as recited in claim 23, wherein said dot-matrix liquid crystal display includes a transparent front plate having a single front electrode.

* * * * *